US008434194B2

(12) United States Patent
Jeong et al.

(10) Patent No.: US 8,434,194 B2
(45) Date of Patent: May 7, 2013

(54) NOZZLE FOR A VACUUM CLEANER

(75) Inventors: Kyeong Seon Jeong, Changwon (KR); Geun Bae Hwang, Changwon (KR); Kie Tak Hyun, Changwon (KR); Kyu Chun Choi, Changwon (KR); Chang Hwa Sun, Changwon (KR)

(73) Assignee: LG Electronics Inc., Seoul (KR)

( * ) Notice: Subject to any disclaimer, the term of this patent is extended or adjusted under 35 U.S.C. 154(b) by 348 days.

(21) Appl. No.: 12/780,335

(22) Filed: May 14, 2010

(65) Prior Publication Data

US 2010/0287725 A1 Nov. 18, 2010

Related U.S. Application Data

(60) Provisional application No. 61/178,614, filed on May 15, 2009.

(51) Int. Cl.

| | |
|---|---|
| ***A47L 9/04*** | (2006.01) |
| ***A47L 9/06*** | (2006.01) |
| ***A47L 5/10*** | (2006.01) |
| ***A47L 5/26*** | (2006.01) |

(52) U.S. Cl.
USPC ..... 15/375; 15/383

(58) Field of Classification Search ..... 15/375, 15/383, 419; *A47L 9/04, 9/06, 5/10, 5/26, A47L 9/02*

See application file for complete search history.

(56) References Cited

U.S. PATENT DOCUMENTS

| | | | | |
|---|---|---|---|---|
| 5,802,666 | A * | 9/1998 | Jung | 15/387 |
| 6,039,817 | A * | 3/2000 | Payne | 134/21 |
| 6,058,561 | A * | 5/2000 | Song et al. | 15/387 |
| 7,124,467 | B2 * | 10/2006 | Hitzelberger et al. | 15/416 |
| 7,134,164 | B2 * | 11/2006 | Alton | 15/331 |
| 2003/0140449 | A1 * | 7/2003 | Alton | 15/375 |
| 2005/0273971 | A1 * | 12/2005 | Cho et al. | 15/377 |

* cited by examiner

*Primary Examiner* — Brian Glessner
*Assistant Examiner* — Brian D Mattei
(74) *Attorney, Agent, or Firm* — KED & Associates, LLP

(57) ABSTRACT

A nozzle for a vacuum cleaner is provided, the nozzle having a structure in which suction performance may be improved. The nozzle may include a nozzle body, and an agitator rotatably installed in the nozzle body. Air may follow a first flow path through the nozzle, and a second flow path which diverges from the second flow path at the agitator, so as to uniformly distribute air flow through the nozzle.

9 Claims, 7 Drawing Sheets

NOZZLE FOR A VACUUM CLEANER

BACKGROUND

Embodiments relate to a nozzle for a vacuum cleaner.

Generally, vacuum cleaners are devices that suck air containing dusts using a vacuum pressure generated by a suction motor installed inside a main body to filter the dusts in the main body.

In such a vacuum cleaner, air sucked from a suction nozzle should smoothly flow into a cleaner main body. In addition, dusts should be easily separated from air containing the dusts. These are good criteria of vacuum cleaner performance.

Generally, a suction part for sucking foreign substances from a surface to be cleaned is disposed in a bottom surface of the suction nozzle. The foreign substances sucked through the suction part may be introduced into the main body via a predetermined flow path.

However, according to a related art vacuum cleaner, there is a limitation that a suction force of the suction motor is not uniformly applied to the suction part. Furthermore, there is a limitation that the suction force is weakly applied to both sides of the suction nozzle. In this case, the suction performance of the suction nozzle may be deteriorated.

SUMMARY

Embodiments provide a nozzle for a vacuum cleaner in which a suction force of a suction motor is uniformly applied to an entire surface of the suction nozzle.

Embodiments also provide a nozzle for a vacuum cleaner in which a structure of a foreign substance suction flow path disposed in the suction nozzle is improved to improve suction performance of the nozzle.

In one embodiment, a nozzle for a vacuum cleaner includes: a nozzle body in which a first flow is generated; an agitator rotatably coupled to the nozzle body; a cover member covering at least side of the agitator, the cover member including a slit part by which at leas portion of the first flow is bypassed; and a flow path formation part through which a second flow passing through the slit part flows, the flow path formation part being disposed in the nozzle body.

According to the nozzle for the vacuum cleaner, the suction force of the suction motor may be uniformly applied to both ends of the suction nozzle to easily absorb foreign substances from a surface to be cleaned.

Also, since a separate flow path is disposed in a cover of the suction nozzle to suck the foreign substance, a phenomenon in which the foreign substances are not sucked into the main body due to a rotation flow generated in an agitator of the suction nozzle may be minimized.

Thus, since the foreign substances sucked through the suction nozzle are easily introduced into the main body of the cleaner, the suction performance of the cleaner may be improved. Therefore, user's product reliability may be improved.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 1:
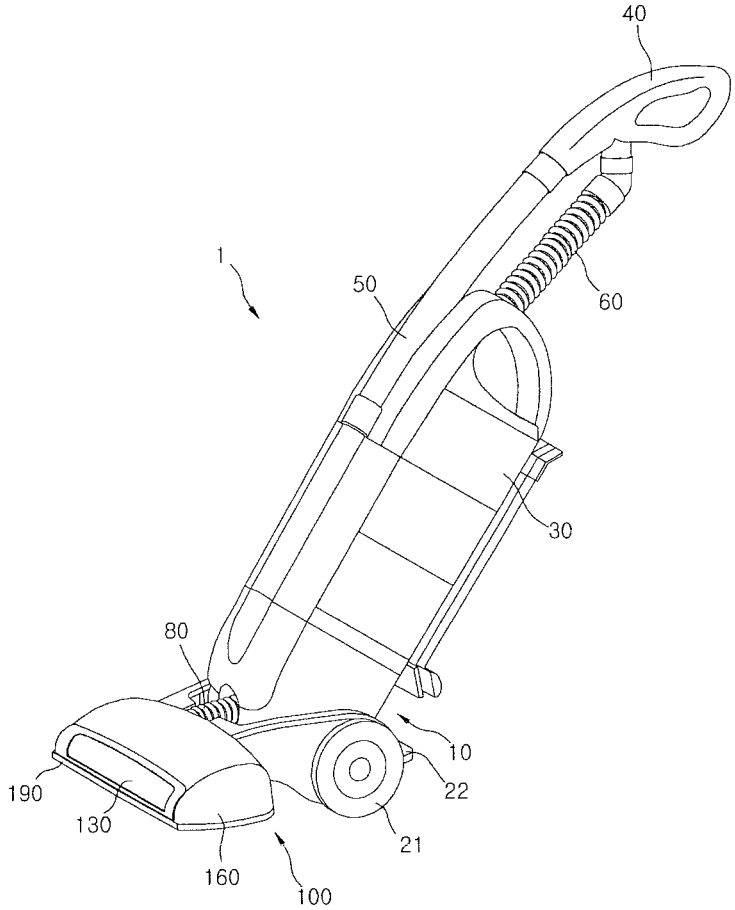
FIG. 1 is a perspective view of a vacuum cleaner according to an embodiment.

FIG. 1 is a perspective view of a vacuum cleaner according to an embodiment.

Referring to FIG. 1, a vacuum cleaner 1 according to an embodiment includes a main body 10 defining an outer appearance thereof and a suction nozzle 100 disposed at a side of the main body 10 to suck air containing foreign substances from a surface to be cleaned.

In detail, the main body 10 includes a driving part (not shown) for providing a suction force. The driving part may include a suction motor. The suction force generated in the suction motor may be applied to the suction nozzle 100.

A handle 40 for moving the main body 10 and the suction nozzle 100 is disposed on an upper portion of the main body 10. A grasp part for allowing a user to easily grasp the main body 10 may be disposed on the handle 40.

Also, the handle 40 is connected to the main body 10. The main body 10 includes a suction tube 50 through air containing foreign substances flows when a portion expect a floor is cleaned and a connection hose 60 through which the air sucked through the suction tube 50 flows into the main body 10.

Also, the main body 10 includes a suction flow path tube 80 connected to the suction nozzle 100 to allow the air sucked through the suction nozzle 100 to flow into the main body 10. The suction flow path tube 80 may be formed of a flexible material.

The suction nozzle 100 sucks the air containing the foreign substances of the floor while adjacently moving along the floor. The suction nozzle 100 includes a nozzle body (see reference numeral 110 of FIG. 2) defining an outer appearance thereof and an upper cover 160 covering an upper side of the nozzle body 110.

The main body 10 is rotatably coupled to the suction nozzle 100. The main body 10 is rotated with respect to the suction nozzle 100 within a range of a predetermined angle. A rotation lever 22 for controlling the rotation of the main body is disposed at a side of an upper portion of the suction nozzle 100.

Moving wheels 21 for easily moving the suction nozzle 100 are disposed on both sides of the suction nozzle 100. The user may push or pull the handle 40 to allow the moving wheels 21 to be rotated.

Figure 2:
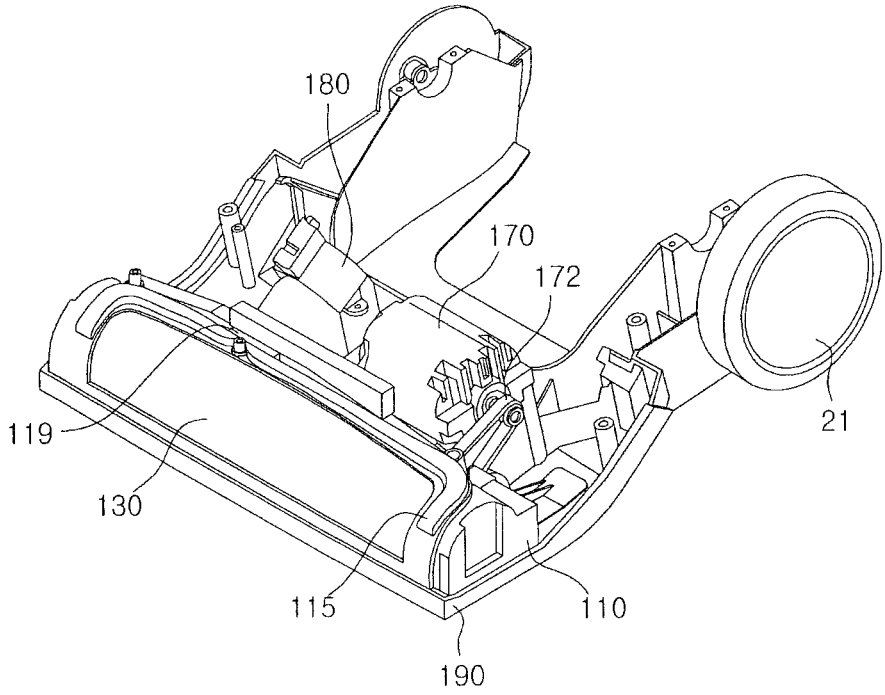
FIG. 2 is a perspective view illustrating a suction nozzle of a vacuum cleaner according to an embodiment.
Figure 3:
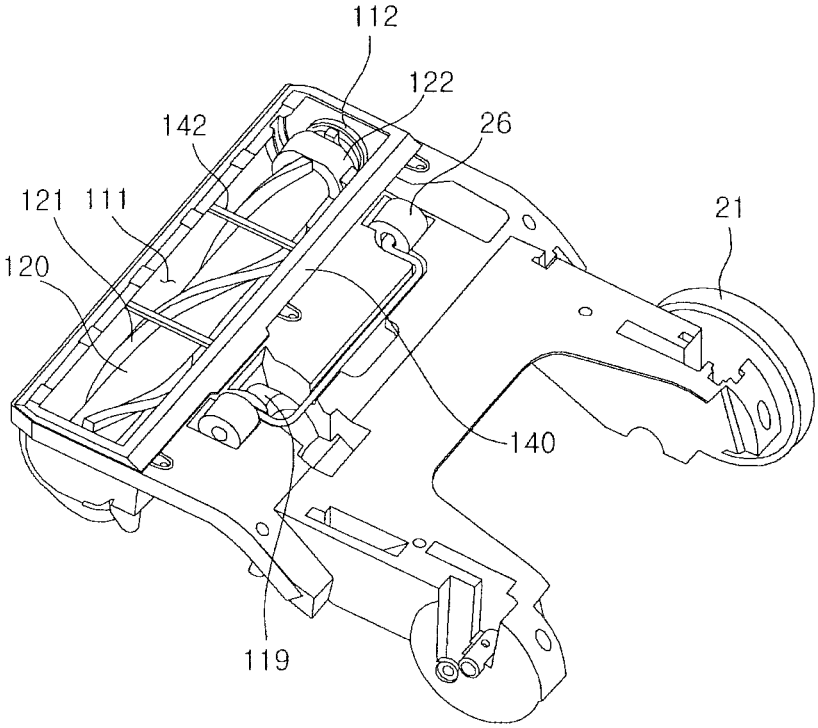
FIG. 3 is a rear perspective view of a suction nozzle according to an embodiment.

FIG. 2 is a perspective view illustrating a suction nozzle of a vacuum cleaner according to an embodiment, and FIG. 3 is a rear perspective view of a suction nozzle according to an embodiment. A configuration of the suction nozzle from which the upper cover 160 is separated is illustrated in FIG. 2.

Referring to FIGS. 2 and 3, the suction nozzle 100 according to an embodiment includes a nozzle body 110 defining an outer appearance thereof and a connection tube 180 disposed in the nozzle body 110 to allow the air sucked through the suction nozzle to flow into the main body 10. The connection tube 180 connects the nozzle body 110 to the main body 10.

A united, or common, pipe 119 in which a plurality of suction flow paths (that will be described later) is united is disposed on the nozzle body 110. The air sucked into the nozzle body 110 may be introduced into the main body 10 via the united pipe 119 and the connection tube 180.

A main suction part 111 through which the air containing the foreign substances is sucked is defined in a bottom surface of the nozzle body 110. At least portion of the bottom surface of the nozzle body 110 is opened to define the main suction part 111.

An agitator 120 for separating the foreign substances from the surface to be cleaned is disposed on the nozzle body 110. The agitator 120 is rotatably coupled to an upper side of the main suction part 111. A spiral blade 121 for scraping the surface to be cleaned while rotating may be disposed on an outer circumference of the agitator 120.

Agitator coupling parts 112 to which the agitator 120 is coupled is disposed on both sides of the nozzle body 110. Coupling parts (see reference numeral 122 of FIG. 4) disposed on both sides of the agitator 120 are coupled to the agitator coupling parts 112.

A driving part 170 providing a driving force for rotating the agitator 120 is disposed in the nozzle body 110. The driving part 170 may include a driving motor.

A power transmission part 172 for transmitting the power of the driving part 170 to the agitator 120 is disposed at a side of the driving part 170. The power transmission part 172 may include a belt, but the present disclosure is not limited thereto. For example, a power transmission member such as a chain or a gear may serve as the power transmission part 172.

The power transmission part 172 may be coupled to a side of the agitator 120. For this, a driving connection part 124 to which the power transmission part 172 is connected is disposed on the outer circumference of the side of the agitator 120.

A bottom plate 140 allowing a bottom surface of the nozzle body 110 to be spaced a predetermined distance from the surface to be cleaned is coupled to a lower portion of the nozzle body 110.

At least one bottom guide 142 allowing the main suction part 111 to be spaced from the surface to be cleaned is disposed on the bottom plate 140. The bottom guide 142 may be provided in plurality, and the plurality of bottom guides 142 may pass through the main suction part 111 and be spaced from each other.

In a state where the suction force generated by the suction motor acts, it may prevent the main suction part 111 from adhering to the surface to be cleaned due to the bottom guide 142.

Auxiliary wheels 26 for smoothly moving the suction nozzle 100 may be disposed on the bottom surface of the nozzle body 110. That is, the auxiliary wheels 26 may serve as a movement unit together with the moving wheels 21.

An impact absorption member 190 for buffering an external impact transmitted to the suction nozzle 100 is disposed on a circumference of a lower portion of the nozzle body 110. The impact absorption member 190 is configured to absorb the impact even through the suction nozzle 100 is bumped against a well or an edge when the suction nozzle 100 performs the cleaning process.

A flow path formation part 115 through which at least portion of the air sucked from the main suction part 111 flows is disposed in the nozzle body 110. The flow path formation part, or flowguide, 115 extends from both sides of the nozzle body 110 up to the united pipe 119.

The flow path formation part 115 protrudes upward from the nozzle body 110, and a space in which the air flows may be defined therein.

A cover member 130 covering at least portion of the nozzle body 110 is disposed at a side of the nozzle body 110.

The cover member 130 may be disposed on an upper side of a space in which the agitator 120 is disposed. The cover member 130 may be formed of a transparent material to allow the rotation operation of the agitator 120 to be viewed from the outside. The cover member 130 may be called an "agitator cover" in that the cover member 130 covers an upper side of the agitator 120.

Figure 4:
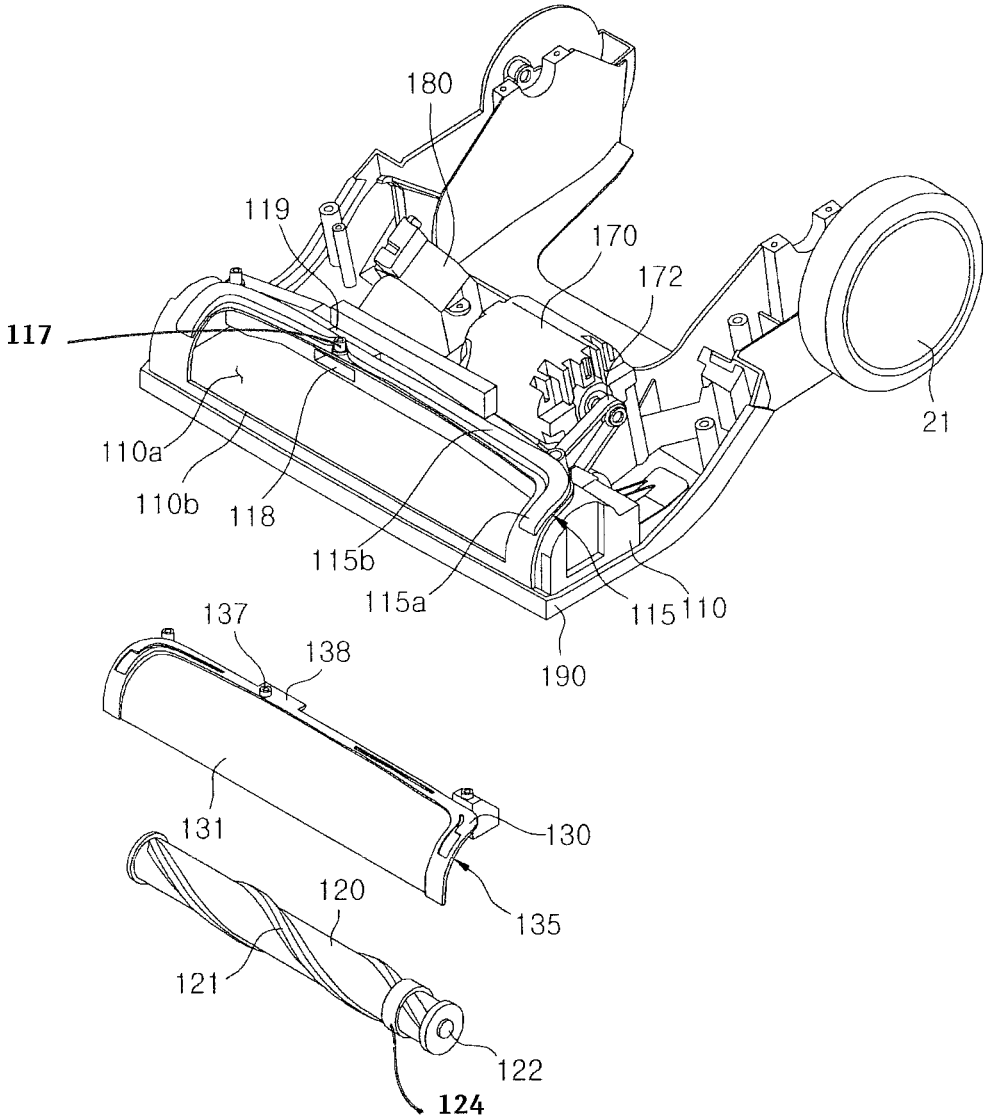
FIG. 4 is an exploded perspective view of a suction nozzle according to an embodiment.
Figure 5:
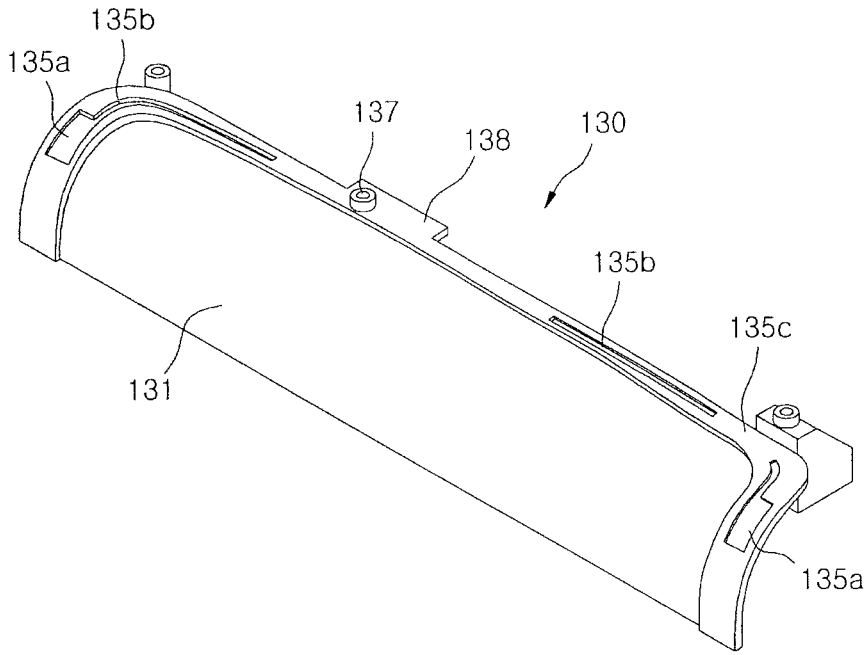
FIG. 5 is a perspective view of a cover member according to an embodiment.

FIG. 4 is an exploded perspective view of a suction nozzle according to an embodiment, and FIG. 5 is a perspective view of a cover member according to an embodiment.

Referring to FIGS. 4 and 5, the suction nozzle 100 according to an embodiment includes the nozzle body 110 defining a lower outer appearance thereof, the agitator 120 rotatably coupled to the nozzle body 110, and the cover member 130 covering the upper side of the agitator 120 in a state where the agitator is coupled to the nozzle body 110.

In detail, a mounting space **110*a* in which the agitator 120 is disposed is defined in the nozzle body 110. The mounting space 110*a* extends upward from the main suction part 111 with a size capable of receiving the agitator 120**.

An opening **110*b* opened in front and upper sides of the mounting space 110*a* is defined in the nozzle body 110. The cover member 130 is disposed on the opening 110*b***.

A first coupling rib 117 for coupling the cover member 130 is disposed on the nozzle body 110. A second coupling rib **1371*s* disposed at a position corresponding to the first coupling rib 117 on the nozzle body 110**.

The first coupling rib 117 and the second coupling rib 137 may be coupled to each other by a separate coupling member (not shown). Although a separate reference number, a plurality of coupling ribs may be disposed on the nozzle body 110 and the cover member 130.

A suction hole 118 through which the air sucked from the main suction part 111 is sucked is defined in the nozzle body 110. The suction hole 118 communicates with the united pipe 119, and the air sucked through the main suction part 111 may flow into the united pipe 119 through the suction hole 118.

The flow path formation part 115 in which at least portion of the air sucked from the main suction part 111 flows is disposed in the nozzle body 110.

The flow path formation part 115 includes lateral parts **115*a* protruding upward from both sides of the nozzle body 110 and an extension part 115*b* extending from the each lateral part 115*a* in a center direction of the nozzle body 110. A side of the extension part 115*b* communicates with the united pipe 119**.

The cover member 130 includes a cover body 131 formed of a transparent material and slit parts 135 by which at least portion of the air sucked from the main suction part 111 is bypassed. At least side of the cover body 131 is opened to define the slit parts 135.

Referring to FIG. 5, the respective slit parts 135 include a slit end **135*a* allow the sucked air to be bypassed toward an upper side of the cover body 131 and an extension slit 135***b* extending from the slit end 135*a* in a center direction of the cover member 130.

Here, the slit part 135 may be disposed on both sides of the cover body 131. A shield part 135*c* may be disposed on one slit part 135 of the two slit parts 135 to space the slit end 135*a* from the extension slit 135*b*. The power transmission part 172 may be disposed below the shield part 135*c*.

A guide rib 138 coupled to the suction hole 118 is disposed at a rear side of the cover member 130. The guide rib 138 may be inserted into the suction hole 118 and allow the nozzle body 110 and the cover member 130 to be closely attached to each other.

In this case, a flow (first flow) passing through the suction hole 118 from the main suction part 111 and a flow (second flow) passing through the flow path formation part 115 are separated from each other, and thus, the first and second flows may be stabilized.

A position and configuration extending from the slit end 135*a* to the extension slit 135*b* may correspond to those of the flow path formation part 115 in a state where the cover member 130 is coupled to the nozzle body 110.

In detail, the slit end 135*a* is disposed below the lateral parts 115*a* of the flow path formation part 115, and the extension slit 135*b* is disposed below the extension part 115*b*.

Thus, the sucked air bypassed through the slit end 135*a* may flow into the united pipe 119 via the extension part 115*b* within the lateral part 115*a*. Also, the sucked air bypassed through the extension slit 135*b* may flow into the united pipe 119 from the inside of the extension part 115*b*.

Figure 6:
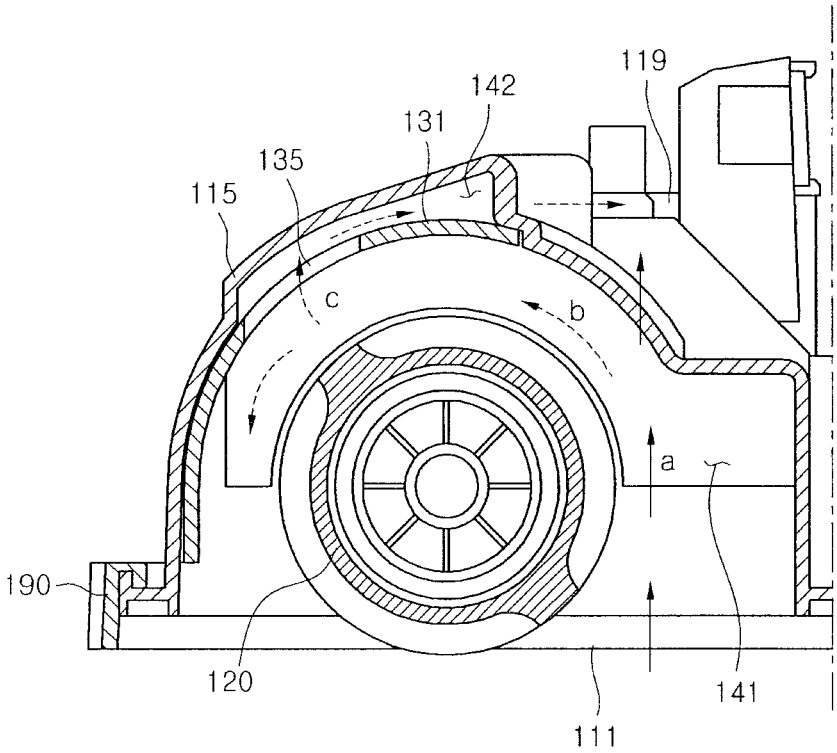
FIG. 6 is a sectional view taken along line I-I' of FIG. 2.
Figure 7:
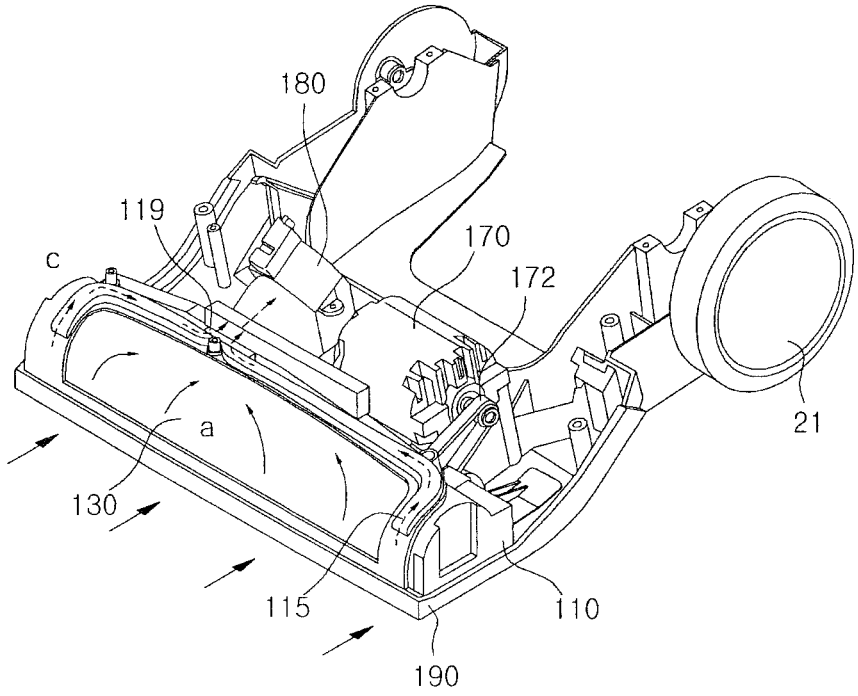
FIG. 7 is a perspective view of an air flow in a suction nozzle according to an embodiment.

FIG. 6 is a sectional view taken along line I-I' of FIG. 2, and FIG. 7 is a perspective view of an air flow in a suction nozzle according to an embodiment.

An air flow according to am embodiment will be described with reference to FIGS. 6 and 7.

The air sucked through the main suction part 111 of the suction nozzle 100 may be sucked into the main body 10 of the cleaner while forming a plurality of flows.

The plurality of flows includes a first flow (an "a" direction of FIG. 6) in which the air sucked through the main suction part 111 flows into the united pipe 119 via the suction hole 118 and a second flow (a "c" direction of FIGS. 6 and 7) in which at least portion of the first flow is bypassed to pass through the flow path formation part 115 and flow into the united pipe 119.

Here, the first flow may be called a "main flow", and the second flow may be called a "sub flow". The first flow and the second flow are united at the united pipe 119 to form a "united flow". The united flow may be sucked into the main body of the cleaner via the connection tube 180.

In detail, a main flow path 141 through which the first flow passes is disposed at a rear side of the nozzle body 110. That is, a large amount of air sucked through the main suction part 111 may flow into the united pipe 119 via the main flow path 141.

A sub flow path 142 through which the second flow passes is disposed at an upper side of the nozzle body 110. Here, the sub flow path 142 may be disposed inside the flow path formation part 115. A portion of the air sucked through the main suction part 111 may flow into the united pipe 119 via the sub flow path 142.

The second flow may be classified into a flow flowing from the slit end 135*a* to the lateral part 115*a* and a flow flowing from the extension slit 135*b* to the extension part 115*b*.

A small amount of the suction force of the suction motor may be applied to both ends of the nozzle body 110 disposed at a relatively long distance from the united pipe 119.

However, since the suction force may be applied through the sub flow path extending from the slit end 135*a* to the flow path formation part 115, the suction force may be sufficiently applied to both ends of the nozzle body 110. As a result, the suction performance of the nozzle may be improved.

In addition, a rotation flow equal to a flow "b" of FIG. 6 may be generated within the nozzle body 110 when the agitator 120 is rotated. According to a related art cleaner, there is a limitation that sucked air does not flow into a main body by the rotation flow, but continuously flow.

However, according to the embodiment, the separate flow (second flow) flowing into the sub flow path 142 through the slit ends 135*a* and the extension slit 135*b* may be generated to flow into the united pipe 119. Therefore, the suction performance of the nozzle may be improved.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A nozzle for a vacuum cleaner, the nozzle comprising:
- a nozzle body;
- an agitator rotatably installed in an installation space provided in the nozzle body; and
- a cover coupled to an opening in the nozzle body so as to cover the agitator installed in the installation space, the cover comprising;
  - a cover body;
  - a frame extending along an outer peripheral portion of the cover body and having a top side and two opposite lateral sides; and
  - at least one slit formed in the frame, the at least one slit comprising:
    - a first slit opening formed in a first of the two opposite lateral sides; and
    - a first slit extension that extends from the first slit opening into the top side;
- wherein the nozzle body defines a first flow path that that directs air from an inlet into the nozzle body to an outlet of the nozzle body, and the nozzle body and the cover define a second flow path that branches off from the first flow path so as to direct air from the first flow path through the cover and then out of the nozzle through the outlet of the nozzle body.

2. The nozzle of claim 1, further comprising a flow guide provided along a peripheral portion of the opening in the nozzle body corresponding to the at least one slit formed in the frame, wherein the flow guide receives air from the second flow path through the at least one slit in the frame of the cover and guides the air to the outlet of the nozzle body.

3. The nozzle of claim 2, wherein the inlet into the nozzle body is formed at an open bottom face of the nozzle body, to a rear of the agitator, and the outlet is formed at a top portion of the nozzle body, substantially aligned with the inlet.

4. The nozzle of claim 3, wherein the first flow path extends from the inlet, through the nozzle body, to the outlet, and the second flow path extends from an intermediate portion of the first flow path, through a space formed between the agitator and the cover, through the at least one slit formed in the frame, and out through the outlet of the nozzle body.

5. The nozzle of claim 2, further comprising a common pipe provided at the outlet of the nozzle body, wherein the common pipe is in communication with terminal ends of the first and second flow paths so as to receive and mix air from the first and second flow paths and direct the mixed air out of the nozzle body.

6. The nozzle of claim 1, wherein the at least one slit further comprises a second slit, the second slit comprising a second slit opening formed in a second of the two opposite lateral sides of the frame.

7. The nozzle of claim 6, further comprising a second slit extension formed in the top side of the frame, wherein the second slit extension is separated from the second slit opening by a shield portion of the frame.

8. The nozzle of claim 6, wherein air from the second flow path flows partially around the agitator, through the first and second slit openings and into the flow guide positioned atop the first and second slit openings, and wherein the flow guide directs the air received from the first and second slit openings to the outlet of the nozzle body.

9. A vacuum cleaner comprising the nozzle of claim 1.

* * * * *